US005743522A

United States Patent [19]

Rubscha et al.

[11] Patent Number: 5,743,522

[45] Date of Patent: Apr. 28, 1998

[54] DOCUMENT OR COPY SHEET TRAY SHEET SET SENSOR ACTUATOR

[75] Inventors: Robert F. Rubscha, Fairport; John D. Gramlich, Webster, both of N.Y.

[73] Assignee: Xerox Corporation, Stamford, Conn.

[21] Appl. No.: 749,305

[22] Filed: Nov. 14, 1996

[51] Int. Cl.[6] ..... B65H 7/02

[52] U.S. Cl. ..... 271/265.02; 271/265.01; 271/145; 221/6

[58] Field of Search ..... 116/205; 33/623; 400/703, 708; 414/923; 221/6; 271/258.01, 259, 265.01, 265.02, 145, 110, 111

[56] References Cited

U.S. PATENT DOCUMENTS

| | | | |
|---|---|---|---|
| 4,928,949 | 5/1990 | Ramsey et al. | 271/111 |
| 5,365,322 | 11/1994 | Hamada et al. | 271/259 |
| 5,486,063 | 1/1996 | Fox et al. | 400/708 |
| 5,511,771 | 4/1996 | Rubscha | 271/4.01 |
| 5,596,399 | 1/1997 | Dempsey et al. | 399/45 |

FOREIGN PATENT DOCUMENTS

| | | | |
|---|---|---|---|
| 358089538 | 5/1983 | Japan | 271/258.01 |
| 0071046 | 3/1988 | Japan | 271/110 |
| 404055247 | 2/1992 | Japan | 271/110 |
| 405 170 340 | 7/1993 | Japan | 271/145 |

*Primary Examiner*—H. Grant Skaggs

[57] ABSTRACT

A sheet feeding system for an imaging system with a sheet input tray into which sheets are loaded onto the upper surface to be fed downstream, with a sheet sensing system for automatically providing different electrical control signals in response to different sheet sizes and different orientations of the sheets loaded into the tray, with sensor actuators projecting into the tray at different preset positions, each actuator being movably mounted to normally project upwardly through an aperture in the tray until operatively engaged by the sheets loaded onto the sheet input tray extending over the preset position of the actuator. Each actuator has an operative shape tapering upwardly from a relatively large base to a relatively small tip to provide laterally angled sheet engagement surfaces on at least three lateral sides thereof, preferably pyramid shaped. These surfaces are sufficiently angled to push down the actuator and prevent jamming or damage to the actuator from stocks of sheets being manually inserted into the sheet input tray from different angles and directions, especially, laterally.

5 Claims, 5 Drawing Sheets

DOCUMENT OR COPY SHEET TRAY SHEET SET SENSOR ACTUATOR

Disclosed herein is an improved sheet size and/or orientation sensing system which is more robust and damage resistant and also more reliable in actuation.

In particular, there is disclosed in the embodiment hereinbelow an improved, low cost and simple sensor actuator for the sensing of, for example, the loading, the sheet sizes and/or the sheet orientation of sheets being loaded into a document input tray of a document feeder, or into a copy sheet loading tray for a reproduction apparatus, which sensor actuator is much less likely to be damaged or jammed by sets or stacks of sheets being inserted into the tray, even if the inserted set or stack of sheets is heavy, and/or is inserted into the tray from various different angles or directions, and/or is inserted into the tray rapidly or roughly, etc., as will be further explained hereinbelow, along with further described features or advantages.

By way of background, there are various needs in various imaging or reproduction systems for reasonably accurate information as to specifics of user or operator loading of sheets of documents or copy sheets into sheet input or loading trays thereof, instead of requiring manual operator key entry of such information, which is often more human error prone as well as more burdensome or confusing to the user. Such desired information is preferably obtained instead by automatically generated electronic sensor signals for the machine controller. It may include sensor signals as to any or all of (and is not limited to): the fact of sheet loading, i.e., the presence or absence of any sheets at all in the tray at that time; the size or sizes of the sheets loaded in that tray at that time; and/or the orientation of the sheets loaded into that tray at that time. This is particularly important for original document input trays or for special or bypass copy sheet materials input trays, where the sizes or orientations of the inputted sheets may vary more widely, and more frequently, (especially as compared to other copy sheet input trays or cassettes dedicated to only one standard size of copy sheets, such as letter size sheets, where the cassette itself can have unexposed sheet size encoding or switch actuating means).

While it is known to obtain some such sheet size or orientation information from the setting or position of side or end guides in a sheet input tray, as shown for example in Xerox Corp. U.S. Pat. No. 5,511,771 issued Apr. 30, 1996 to the same Robert F. Rubscha, and other art cited therein, etc., that is not effective for other or all such desired information in all cases. Thus, it is desired or necessary in some cases, especially for document feeders for imaging stations, to provide mechanical sheet sensor actuators which extend into the stacking trays sheet stacking area itself, in desired sensing locations, to engage and sense the presence or absence of inserted documents of differing sizes or orientations in those preset tray positions sensing locations. Known alternatives of direct optical or light beam sensors have limitations, including difficulty in detecting transparencies, and use in open access trays except in angled beam aiming corner locations. Furthermore, to be effective, tray sheet sensor actuators must be delicate enough to detect input of lightweight sets or even single lightweight sheets. To use mechanically actuated sensors, some portion thereof needs to extend into or above the tray to be engaged by the sheets. However, that makes such extending document engaged mechanical actuators exposed to and vulnerable to damage and/or jamming, especially by large and heavy sets of sheets inserted quickly, carelessly, roughly, and/or from different angles into the same tray, as frequently occurs in normal office copying or imaging. Thus, many prior such document sensing systems had exposed actuators comprising fingers or arms extending up from the tray surface to be pressed down by the loaded sheets which not only appeared flimsy and vulnerable, but were. Although such actuators may typically be designed to actuate their connecting sensor switches by being depressed below the tray surface by overlying sheets, before that can happen, the inserted sheets can strike the sensor actuator sideways, from almost any direction, which can cause the sensor to be deflected sideways and be bent or damaged, and/or hung up against the side of the tray aperture through which the actuator is intended to be pushed down to actuate the sensor switch.

Specific features of the specific embodiment disclosed herein include a sheet feeding system for an imaging system with a sheet input tray in which sheets are loaded onto the upper surface of said sheet input tray to be fed downstream therefrom, and a sheet sensor system for automatically providing different electrical control signals in response to different sheet sizes and different orientations of the sheets loaded onto said sheet input tray, said sheet sensor system having at least one mechanical sheet sensor actuator projecting into said sheet input tray at a preset position to be engaged and moved to a sensor actuation position by said sheets loaded onto said sheet input tray when said sheets loaded onto said sheet input tray extend into said preset position of said actuator in said sheet input tray, said actuator being movably mounted to normally project upwardly through an aperture in said sheet input tray at said preset position until operatively engaged by said sheets loaded onto said sheet input tray extending into said preset position; said actuator having an operative shape tapering upwardly from a relatively large base up to a relatively small tip to provide laterally angled sheet engagement surfaces on at least three lateral sides thereof, said laterally angled sheet engagement surfaces of said actuator being sufficiently angled to push down said actuator and prevent jamming or damage to said actuator from stacks of sheets being manually inserted into said sheet input tray from different angles and directions, including laterally.

Further specific features disclosed in the embodiment herein, individually or in combination, include those wherein said actuator is pyramid shaped; and/or wherein said actuator is mounted to an arm pivotally mounted under said sheet input tray, which arm is operatively connected to a sensor actuator for actuating said sheet sensor system; and/or wherein there are two separate and independently actuatable said actuators spaced within said sheet input tray, spaced substantially spaced apart from one another by a preset distance in said downstream direction, to provide a combination of sheet size and position sensing signals; and/or wherein said actuator has one side surface thereof which is substantially vertical facing downstream in said sheet input tray to allow said actuator to move closely adjacent to the end of a stack of sheets in said sheet input tray.

It is well known that the control of document and copy sheet handling systems may be accomplished by actuating them with signals from a microprocessor controller directly or indirectly in response to programmed commands and/or from selected actuation or non-actuation of switch inputs. The resultant controller signals may conventionally actuate various conventional electrical solenoid or cam-controlled sheet deflector fingers, motors or clutches, or other components, in programmed steps or sequences, and/or controlling the operation of sheet feeders and inverters, etc., as is well known in the art. However, accurate and consistent switch input signals are necessary for accurate such control functions, to insure proper sheet feeding and avoid sheet jams, sheet damage, or machine damage.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of these specific embodiments, including the drawing figures (approximately to scale) wherein:

Figure 5:
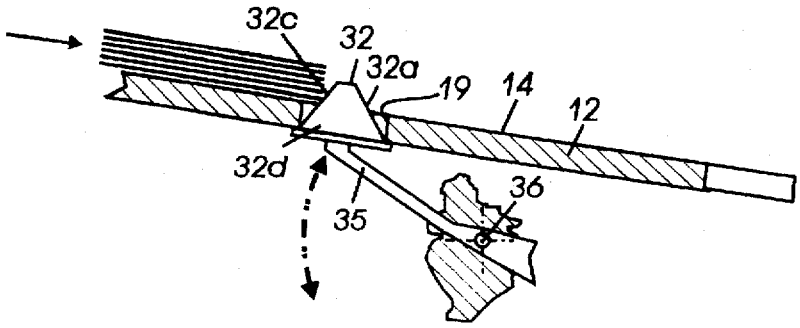
Figure 6:
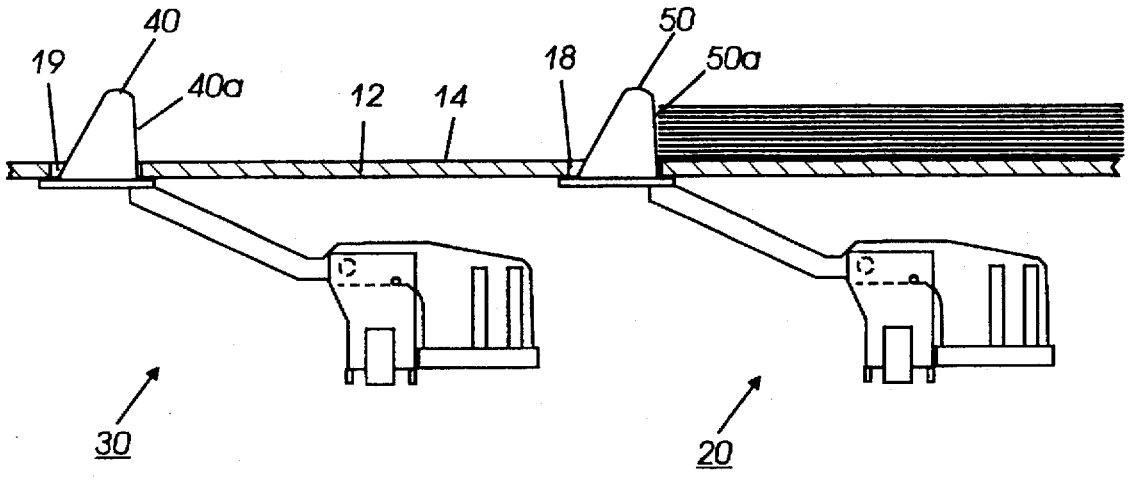
Figure 7:
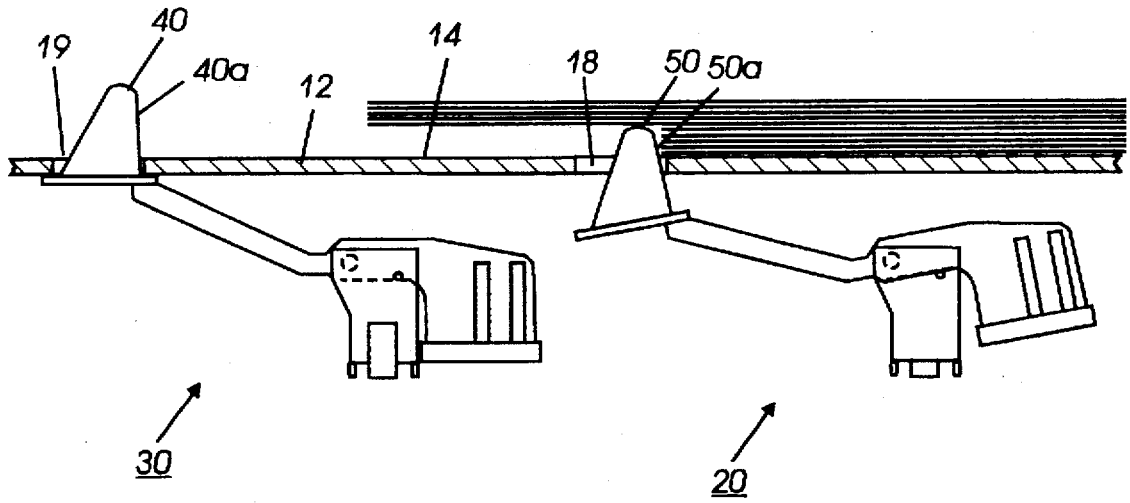
Figure 8:
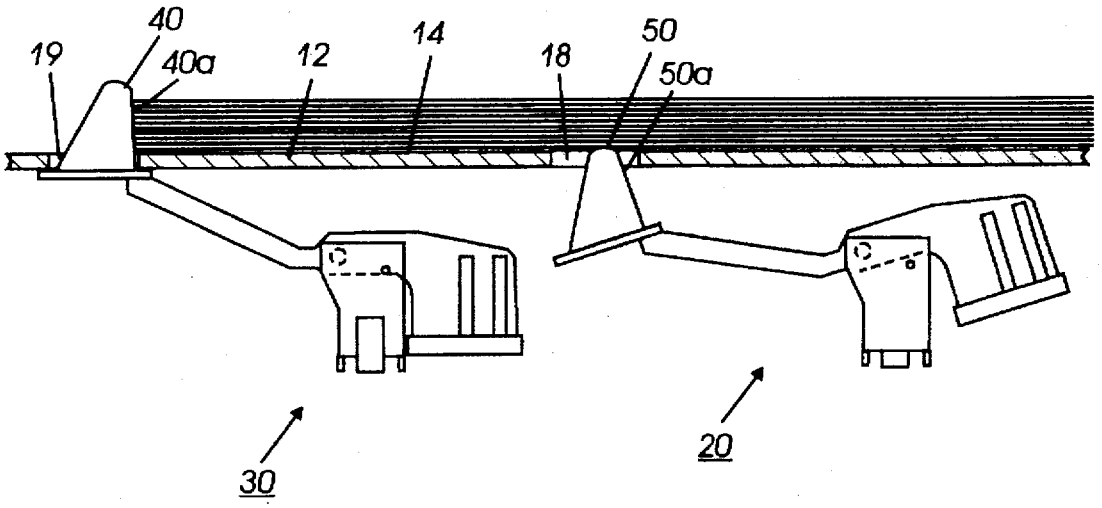
Figure 9:
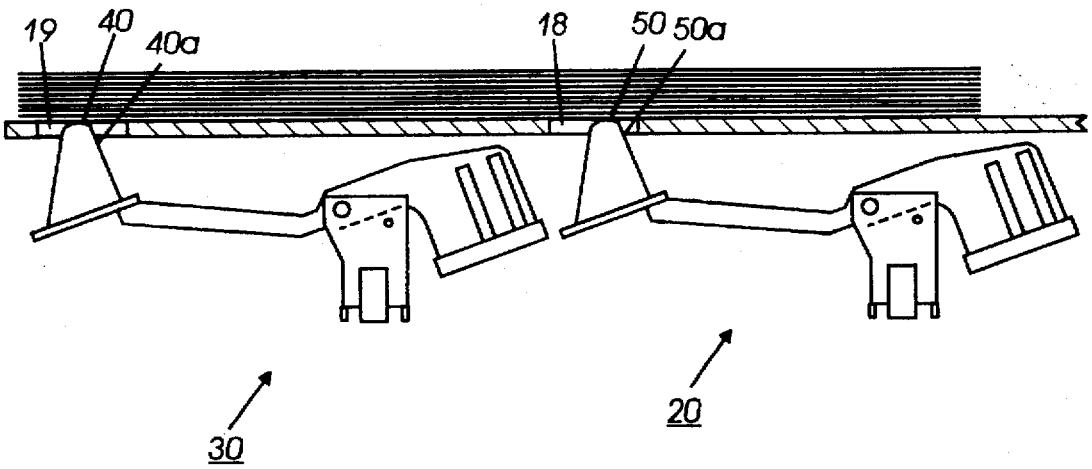

FIG. 5 is an exposed partial side view of one of the two sensor systems of the embodiments of FIGS. 1–4 about to actuated, as shown by its dashed line movement arrow, by the leading edge of a substantially horizontal insertion of a stack of sheets being loaded into the tray as shown by its movement arrow; and FIGS. 6–9 show in the same partial exposed side view, but in four different document size and/or orientation sensing positions, a slightly different embodiment wherein the inside surface of the sensor actuator per se is substantially vertical rather than sloped like the other actuator engaging surfaces; wherein in FIG. 6 a stack of small and/or landscape (long edge first) oriented sheets in the tray does not actuate either of the two sensor systems, and wherein in FIG. 7 with a mixed set of sheets in the tray with larger sheets on top the inboard sensor is actuated, and wherein in FIG. 8 a larger set of sheets extends fully to but does not actuate the outboard sensor, and wherein in FIG. 9 both sensors are actuated by a larger, or portrait (short edge first) oriented, sheet stack in the tray.

Describing now in further detail the exemplary embodiments with reference to the Figures, there is shown, merely as one example of a document handler, an exemplary document handler (DH) 10 generally similar to that of U.S. Pat. No. 5,534,989 issued Jul. 9, 1996 to the same Robert F. Rubscha, et al., but here having an example or embodiment of a more robust and reliable document set input sensing system in accordance with the subject invention. In this example, this comprises an inboard document sensor system 20 and (an otherwise identical but differently positioned) outboard document sensor system 30, respectively actuated or not by the sheets loaded into the input tray depending on the sheet size and orientation, so as to provide automatic electrical signals information thereof which can be used to control the document handler or the document imaging system. Conventionally, a preset time delay is provided in the controller 100 after a sensor is actuated before it is read, to allow time for the operator to fully load the documents into their fully inserted position in the tray and to fully release them.

As previously noted, the disclosed improved sheet sensing systems may also be incorporated into copy sheet input trays, especially alternate or special "bypass" trays for the input of transparencies or other special sheets, as in U.S. Pat. No. 4,337,935; or U.S. 5,496,019 issued Mar. 5, 1996 to John R. Yonovich. Since those copy sheet trays per se and their functions are well known, they need not be illustrated or described further herein. The respective electrical on or off signals from the sheet size and/or orientation sensors in the trays can be used to control any of various copy sheet imaging, magnification, reduction, printing, finishing and/or other functions, as are known to those skilled in the reproduction systems arts.

As noted above, the exemplary document handler 10 here and its tray 12 are shown per se in further detail in the above cited and other U.S. patents and need not be further described herein. The tray 12 has an upper surface 14, on which the inserted sheets are supported, and may also have repositionable sheet side guides such as 16 and 17. The upper tray surface 14 here has two spaced apart apertures, 18 inboard and 19 outboard, for sensor actuation for sheets extending into those two respective different positions of the tray after they are loaded, as will be described.

Variously shown in the disclosed embodiments of the Figures is a virtually indestructible and attractively pyramid shaped sheet size sensor actuator for the respective sheet presence sensing systems 20 and 30. Two of these exposed sensor actuators, 32 and 33, are shown in this exemplary document handler (DH) 10 input tray 12, but only one of them, here the outboard sensing system 30 actuator 32 extending thorough aperture 19, need be described herein, since they may both be the same except for their two different tray positions. It will be appreciated that, in different DH systems, one, or three or more, such sensor actuators could be provided in different locations on the tray surface.

Figure 3:
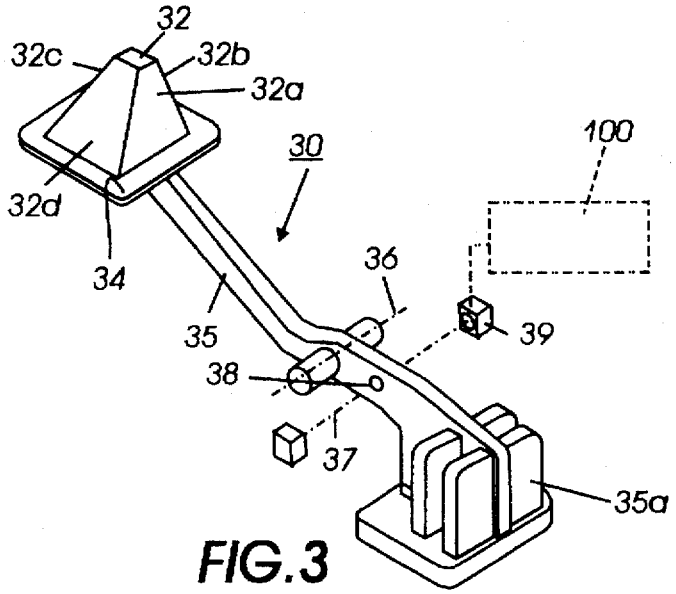
FIG. 3 is an enlarged perspective view of a desirably generally pyramid shaped sensor actuator and its connecting arm per se of the embodiments of FIGS. 1 and 2.
Figure 4:
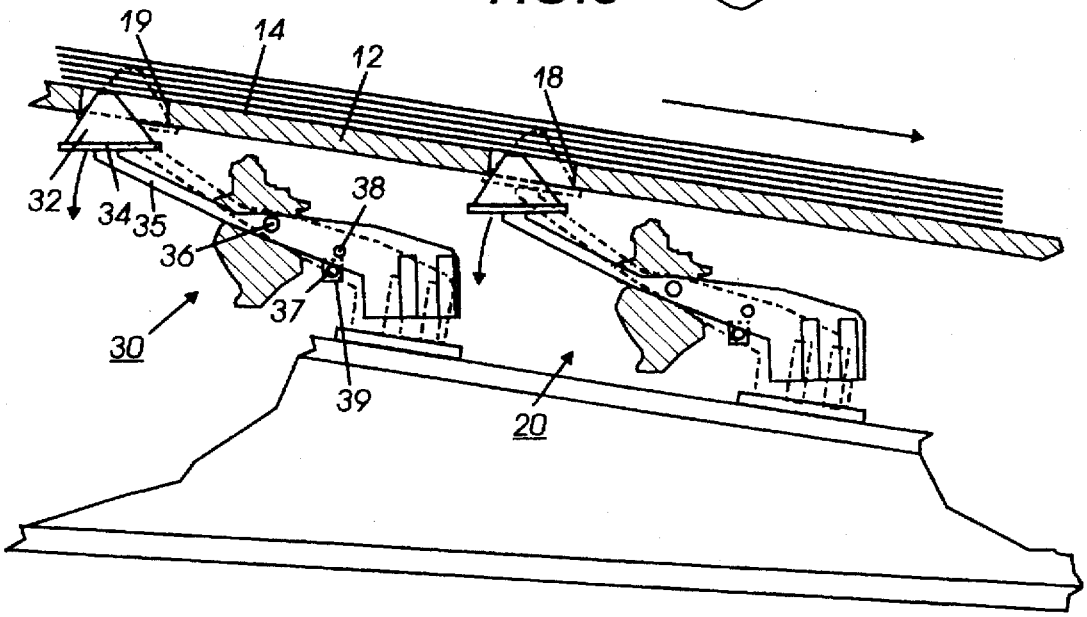
FIG. 4 is an exposed partial side view of the two sensor systems of the embodiments of FIGS. 1, 2 and 3, both actuated in their solid line positions (from their unactuated phantom line positions) by an overlying stack of large sheets loaded into the tray.

Referring to this sheet presence sensor or switch actuator 32 per se in more detail, FIG. 3 provides an enlarged and separated view. Note that the description herein of actuator 32 and the sensing system 30 it actuates also generally applies to the alternative embodiment actuator 40 of FIGS. 6–9, with differences in its inside or inboard surface 40*a* which will be discussed later.

The disclosed sensor actuator 32 has a large base 34 below the tray upper surface 14, which base 34 serves as a vertical movement stop by being wider than aperture 19 and thus engaging the under-surface of the tray 12 around aperture 19 (see, e.g., FIG. 5). The actuator 32 has, integrally extending upwardly from base 34, sheet stack engagement surfaces 32*a*, 32*b*, 32*c*, 32*d*. Normally, that is, when not being actuated by being pressed down by overlying sheets of paper, the actuator 32 extends slightly above the tray surface 14. That is, the stack engagement surfaces 32*a*, 32*b*, 32*c*, 32*d* are exposed by extending up through aperture 19 to above the tray surface 14. These downwardly outwardly sloping side surfaces 32*a*, 32*b*, 32*c*, 32*d* of the actuator 32 result in the actuator 32 increasing in thickness and strength and being only slightly smaller at its base than the tray aperture 19 through which it moves to operate. These pyramid forming sloping surfaces 32*a*, 32*b*, 32*c*, 32*d* are sloped to push the respective extended actuator down (rather than break off or jam) from sheet stack inserting impact from any direction, unlike flimsy fingers on prior products, as is particularly illustrated in FIG. 5, illustrating that even fully lateral impact from any direction with any of these exposed surfaces of the actuator 32, in this case 32*c*, will move the actuator downwardly, due to the vertically sloped angle of inclination of the actuator on all sides.

Here, the actuator 32 base 34 is mounted to an actuator connecting arm 35, which is intermediately pivotally mounted internally under the tray 12 to partially rotate on a pivot axis 36. The integral extension of this arm 35 on the other side of pivot axis 36 is integrally weighted at 35*a* to hold down that end of the arm 35 and therefor normally hold up the actuator 32 in its above-described normal exposed position with a small preset force. Also, that weighted end of the arm 35 provides a conventional flag area 38 to actuate sensor system 32 by interruption of the light beam 37 of a conventional optical switch unit 39, electrically connected, as shown in more detail in FIG. 2, to the conventional controller 100 for operation or control of the document handler 10 and/or the document imaging system. The interruption of the light beam 37 by arm 35 area 38 to actuate switch 39 occurs only when the actuator 32 has been pressed down by overlying sheets.

As shown in FIG. 7, that switch actuation position of actuator 32 or 40, or the like, need not be fully depressed, i.e., fully flush with tray surface 14. That is, as shown in FIG. 7, if it is desired to detect larger sheets overlying a set of smaller or differently oriented sheets, this can be easily provided by designing or adjusting the flag 38 to light beam 37 relative positions to actuate the switch 39 with only a preset partial depression of the actuator by the overstocked larger sheets, as shown there.

Other features of both of these actuator embodiments 32 and 40 include the fact that, with little or no cost increase, the unique shape of these sensor actuators as described above provides maximized strength at the base thereof, which is the typical weak point of prior document engaging extending actuators. Furthermore, the uniquely sloped actuator sides shapes extending up through the tray, below the document tray surface, also are important in preventing jams or "hang-ups" between the sides of the actuator and the sides of the tray aperture through which the actuator moves. I.e., if the actuator is forcibly deflected sideways by a laterally inserted set of documents, so as to force the actuator laterally against one side of its tray aperture, the actuator will engage its aperture wall surface with one of its downwardly inclined-plane side surfaces, thereby providing a vector force which will act to lower the actuator below the tray surface, rather than retain it. These features also mean that a higher cost rigid mounting or rigid connecting arm to the sensor switch is not required. That is, by having a tray aperture which is only slightly larger than the base of the actuator, the tray aperture can be used to provides a limit or stop on the maximum lateral movement of the sensor unit no matter what lateral forces are applied to the actuator. Thus, an inexpensive relatively light weight and thin connecting arm can be used for the actuator and between the actuator and the switch, since here the connecting arm and the switch are protected from the high impact forces to which only the exposed actuator is subjected to by careless or even angry operators dropping, throwing or forcibly shoving heavy sets of heavy documents into the document tray from various directions.

Turning now in more detail to the actuators 40 and 50 embodiment of FIGS. 6–9, this is a slightly different embodiment wherein the inside surfaces 40*a* and 50*a* (only) of these sensor actuators are substantially vertical rather than sloped like the other sheet engaging surfaces thereof or those of the actuators 32 and 33. As described above in the FIGS. 6–9 brief descriptions, they are shown in the same view, but in four different document size and/or orientation sensing positions described there. Since all other components may be identical, they need not be redescribed.

The advantages of the inside or downstream facing surfaces 40*a*, 50*a* of actuators 40 and 50 are illustrated in the various different sheet set loading situations shown in these FIGS. 6–9. These modified surfaces avoid partial interference or stubbing and thus erroneous or ambiguous switch actuations by the bottom rear edges of a stack of sheets which happens to have the dimensions to coincide in loading position in the tray 12 with the inside surface of an actuator. By having an actuator surface 40*a* or 50*a* which can be, and can move, substantially parallel to the substantially vertical end of a closely adjacent sheet stack, as shown, this problem is avoided.

Figure 1:
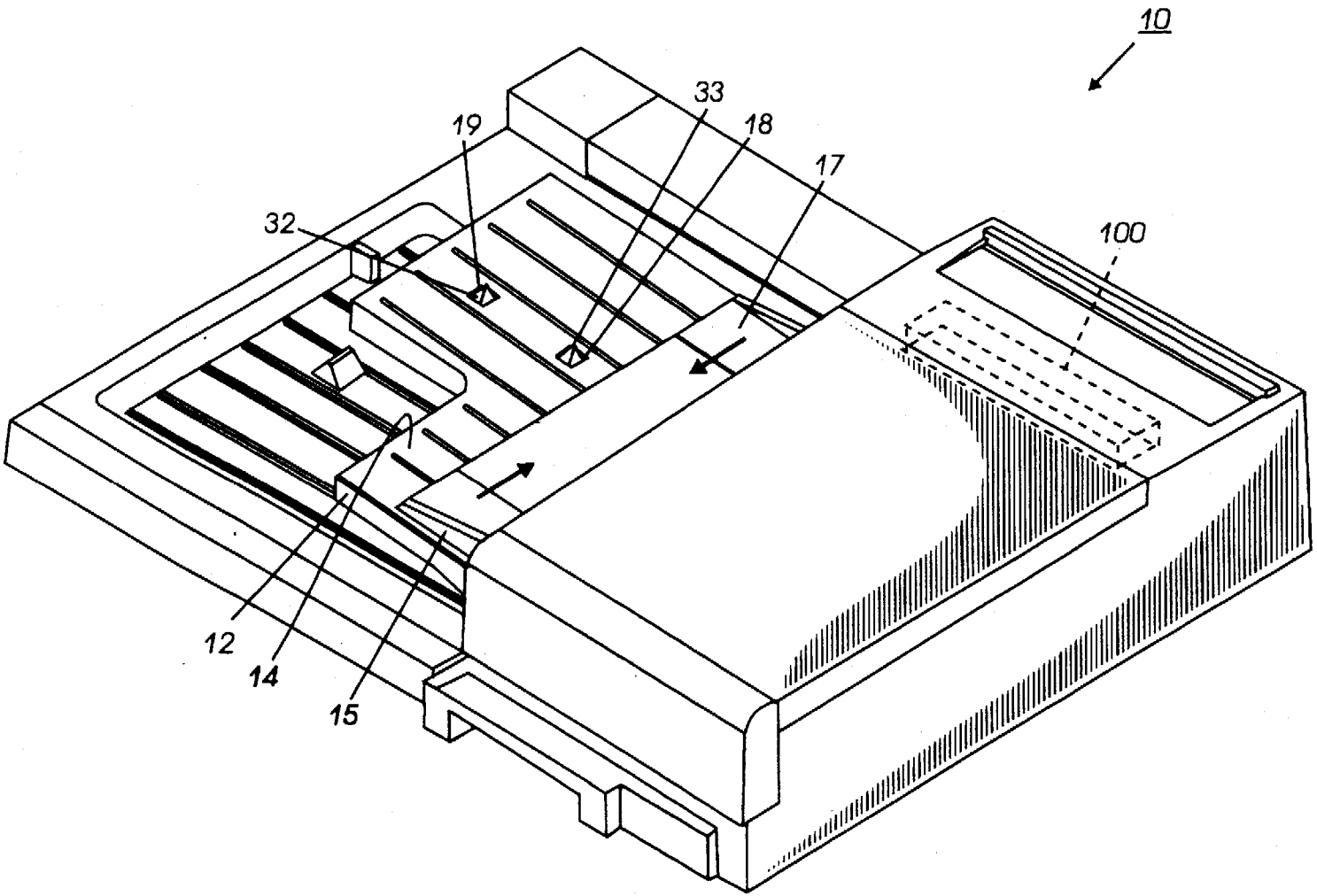
FIG. 1 is a perspective frontal overview of one embodiment of the disclosed sheets input position sensing actuators system, here in the exemplary input tray for document sheets of an exemplary document handler for a document imaging system, also having adjustable side guides as shown by the movement arrows.
Figure 2:
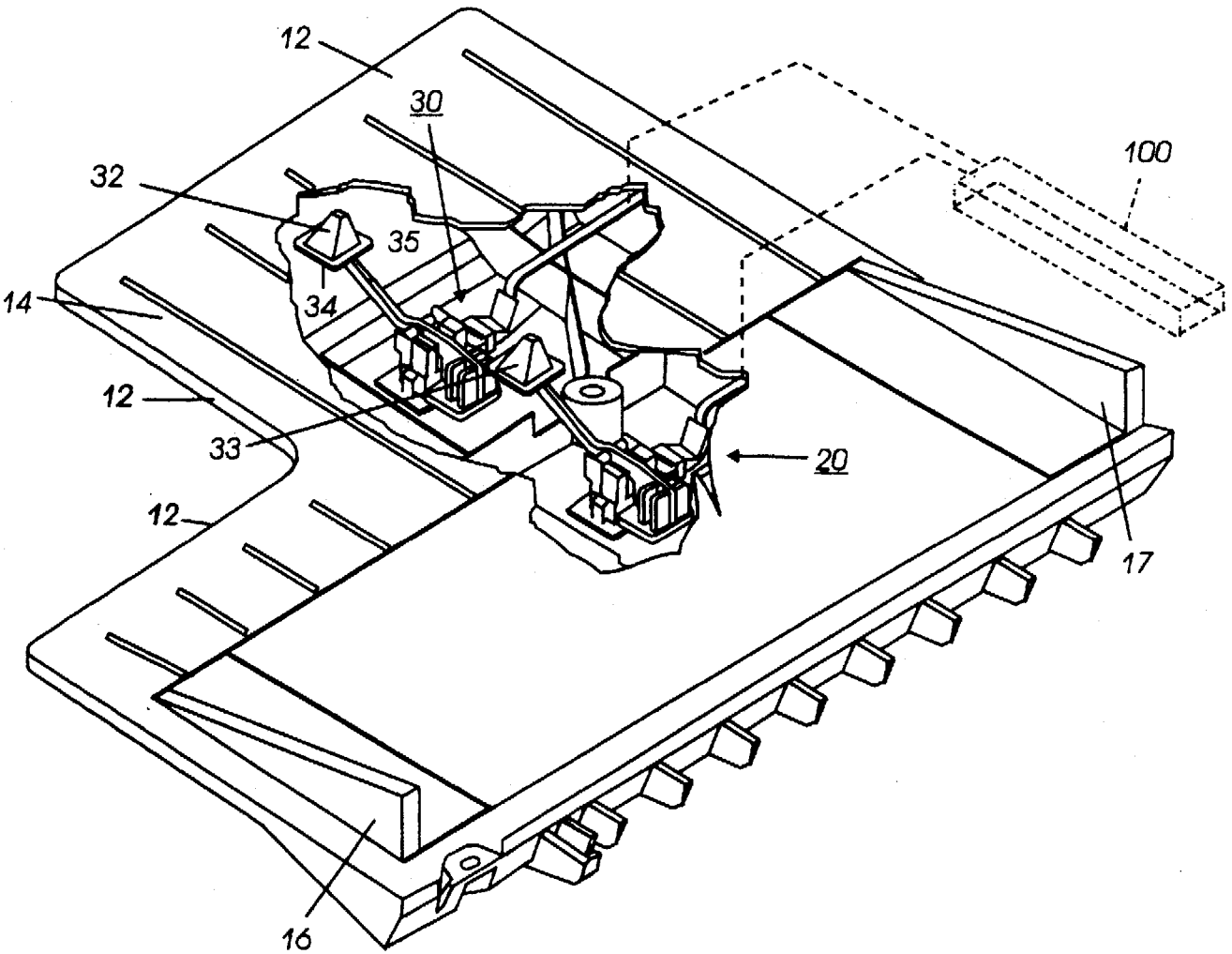
FIG. 2 is a similar perspective view of the documents input tray per se of FIG. 1, but partially broken away to show the two sensor systems under the tray surface.

As shown in FIG. 1, the upstanding downstream housing of the DH 10, as well as the normal sheet insertion requirements of a DH, effectively prevents sheets from being loaded into the tray 12 from that downstream direction. Thus, it has been discovered that there is little danger of lateral impact from on the actuators from that direction, and hence little danger of lateral impact on the facing side surfaces 40*a* or 50*a*, in contrast to the other, sloping, sides. Thus, it has been discovered that the inside or downstream facing surfaces 40*a* and 50*a* do not have the same reasons to be sloped as the other faces of the actuators. As with all of the illustrated actuators, however, these actuators taper from a large base up to a small tip to provide laterally angled sheet engagement surfaces on at least three lateral sides thereof. Likewise, there are two separate and independently actuatable actuators, 40 and 50 here, spaced within the sheet input tray and spaced substantially spaced apart from one another in the upstream to downstream or sheet input direction to provide a desired combination of sheet size and position sensing signals from the preset actuator positions based on the commonly encountered standard sheet sizes in the particular country, e.g., the lengths and/or widths of paper stocks for letter, legal, ledger, etc., as will be well understood by those skilled in the art.

While the embodiments disclosed herein are preferred, it will be appreciated from this teaching that various alternatives, modifications, variations or improvements therein may be made by those skilled in the art, which are intended to be encompassed by the following claims:

We claim:

1. In a sheet feeding system, for an imaging system, with a sheet input tray in which sheets are loaded onto the upper surface of said sheet input tray to be fed in a downstream feeding direction therefrom, said sheet input tray having a sheet sensor system for automatically providing different electrical control signals in response to different sheet sizes and different orientations of the sheets loaded onto said sheet input tray, the improvement in said sheet sensor system comprising at least one mechanical sheet sensor actuator projecting into said sheet input tray at a preset position to be engaged and moved to a sensor actuation position by said sheets loaded onto said sheet input tray when said sheets loaded onto said sheet input tray extend into said preset position of said actuator in said sheet input tray, said actuator being movably mounted to normally project upwardly through an aperture in said sheet input tray at said preset position until operatively engaged by said sheets loaded onto said sheet input tray extending into said preset position; said actuator having a three-dimensional solid geometric shape tapering upwardly from a relatively large base up to a relatively small tip to provide laterally angled sheet engagement surfaces on at least three different lateral sides thereof, said laterally angled sheet engagement surfaces of said actuator being sufficiently angled to push down said actuator and prevent jamming or damage to said actuator from stacks of sheets being manually inserted into said sheet input tray from different angles and directions, including stack insertion laterally of said downstream sheet feeding direction.

2. The sheet feeding system of claim 1, wherein said sheet sensor actuator is pyramid shaped.

3. The sheet feeding system sheet of claim 1, wherein said sheet sensor actuator is mounted to an arm pivotally mounted under said sheet input tray, which arm is operatively connected to a sensor actuator for actuating said sheet sensor system.

4. The sheet feeding system of claim 1, wherein there are two separate and independently actuatable said sheet sensor actuators spaced within said sheet input tray, spaced substantially spaced apart from one another by a preset distance in said downstream direction, to provide a combination of sheet size and position sensing signals.

5. In a sheet feeding system, for an imaging system, with a sheet input tray in which sheets are loaded onto the upper surface of said sheet input tray to be fed in a downstream feeding direction therefrom, said sheet input tray having a sheet sensor system for automatically providing different electrical control signals in response to different sheet sizes and different orientations of the sheets loaded onto said sheet input tray, the improvement in said sheet sensor system comprising at least one mechanical sheet sensor actuator projecting into said sheet input tray at a preset position to be engaged and moved to a sensor actuation position by said sheets loaded onto said sheet input tray when said sheets loaded onto said sheet input tray extend into said preset position of said actuator in said sheet input tray, said actuator being movably mounted to normally project upwardly through an aperture in said sheet input tray at said preset position until operatively engaged by said sheets loaded onto said sheet input tray extending into said preset position; said actuator having a three-dimensional solid geometric shape tapering upwardly from a relatively large base up to a relatively small tip to provide laterally angled sheet engagement surfaces on at least three different lateral sides thereof, said laterally angled sheet engagement surfaces of said actuator being sufficiently angled to push down said actuator and prevent jamming or damage to said actuator from stacks of sheets being manually inserted into said sheet input tray from different angles and directions, including stack insertion laterally of said downstream sheet feeding direction;

wherein said sheet sensor actuator has one side surface thereof which is substantially vertical facing in said downstream direction in said sheet input tray to allow said actuator to move closely adjacent to the end of a stack of sheets in said sheet input tray.

* * * * *